United States Patent [19]

Durland et al.

[11] 4,036,428

[45] July 19, 1977

[54] FLUID PRESSURE OPERATED EDDY CURRENT BRAKE FOR AIR DRIVEN CENTRIFUGE

[75] Inventors: Douglas Howard Durland; Malcolm Canmore McGilvray, Jr., both of Palo Alto, Calif.

[73] Assignee: Beckman Instruments, Inc., Fullerton, Calif.

[21] Appl. No.: 681,303

[22] Filed: Apr. 29, 1976

[51] Int. Cl.[2] ..... B04B 9/06

[52] U.S. Cl. ..... 233/23 R; 74/5.46; 188/164; 210/146; 310/105; 415/123

[58] Field of Search ..... 233/1 R, 1 B, 23 R, 233/23 A, 24; 210/146, 72; 74/5.43, 5.46; 188/164; 310/105; 415/123

[56] References Cited

U.S. PATENT DOCUMENTS

| | | | |
|---|---|---|---|
| 2,106,609 | 1/1938 | Krauss | 210/72 |
| 2,213,107 | 8/1940 | McBain | 233/23 R |
| 3,064,149 | 11/1962 | Baermann | 310/105 X |
| 3,447,006 | 5/1969 | Bair | 310/105 X |
| 3,747,841 | 7/1973 | Ross | 233/24 |
| 3,958,753 | 5/1976 | Durland et al. | 233/23 R |

*Primary Examiner*—George H. Krizmanich
*Attorney, Agent, or Firm*—R. J. Steinmeyer; F. L. Mehlhoff

[57] ABSTRACT

An improved apparatus and method for braking the rotation of a centrifuge rotor is disclosed comprising magnet means operable in a first position wherein substantially no eddy currents are induced in a rotating rotor made of electrically conductive material by the magnetic flux of the magnet means and a second position wherein eddy currents are induced into the rotating rotor sufficiently to slow the rotor. In the preferred embodiment, the magnet means is movable by fluid pressure from the second position to the first position and movable by a bias force from the first position to the second position.

5 Claims, 2 Drawing Figures

FLUID PRESSURE OPERATED EDDY CURRENT BRAKE FOR AIR DRIVEN CENTRIFUGE

BACKGROUND OF THE INVENTION

The present invention relates to centrifuges and more particularly to an improved method and apparatus for braking the rotation of a centrifuge.

In a centrifuge, the problem of decelerating or braking has always been a major factor. A braking device must perform its braking function quickly without causing a remixing of the separated components through undesired vibration and oscillation. Such factors as the mass of the device to be stopped and the speed at which it is rotating have significant effect.

In air driven centrifuges, the braking function is a much more complex problem than in spindle driven centrifuges. An air driven centrifuge, such as illustrated in U.S. Pat. No. 3,456,875 issued to George N. Hein, includes a rotor chamber having a rotor seat and a rotor having a plurality of turbine fins formed on the under side. The rotor seat includes driving air jet means for impinging pressurized air streams against the turbine flutes of the rotor for supporting and spinning the rotor on an air cushion above the rotor seat. In addition, support air jet means may also be provided within the seat for directing pressurized air streams against the under side of the rotor to support the rotor when the driving air jet streams are inactivated. Such an arrangement is disclosed in an application entitled Air Levitation For Air Driven Centrifuge filed concurrently herewith in the name of George N. Hein. When supported and spinning on the air bearing thus formed, the rotor is operating in a virtually frictionless environment.

Because air driven centrifuge rotors are supported on this substantially friction-free cushion of air, it is difficult to design a system employing air braking streams that will make the rotor come to a gradual, complete stop. While great pains in design can be taken to hold any rotational effect due to a supporting air stream to a minimum, it is difficult to completely eliminate any rotational effect. There is always a certain amount of windmilling while the supporting or holding air stream moves across the turbine flutes of such a rotor. In addition, the design of the rotor, or the loading of the sample therein, always introduces certain parameters which create critical speeds at which the rotor will precess, wobble, or vibrate excessively while decelerating. Any unbalanced force applied to the rotor for braking purposes can cause the rotor to move out of its rotational axis where it may come into contact with the sidewalls of its seat and thrash about within the centrifuge chamber.

In an application entitled Eddy Current Brake For Air Driven Centrifuge, filed concurrently herewith in the names of Douglas H. Durland, Robert J. Ehret and George N. Hein, an apparatus and method for providing a rapid and equally balanced deceleration force for a centrifuge rotor is disclosed employing eddy currents. In the preferred embodiment, a magnet means is moved between two positions. In one position, no braking effect is created in the rotating rotor by the flux field of the magnet means. In the second position the magnetic flux field causes the inducement of sufficient eddy currents in an electrically conductive portion of the rotating rotor to cause a braking effect. What is desired, is a novel apparatus for moving the magnet means between these two positions. Additionally, it would be desirable that such apparatus exhibit fail "safe" characteristics.

SUMMARY OF THE INVENTION

The present invention is directed to an apparatus and method of activating an eddy current brake in an air driven centrifuge employing the pressurized air of the centrifuge as the external power source. The apparatus is constructed to go to the braking mode upon loss of air pressure, thus providing the desired fail "safe" attributes. To accomplish this, a magnet or magnets are attached to a nonmagnetic carrier disposed within a chamber in the manner of a piston within a cylinder. The carrier is constructed to move and carry the magnets between the two positions described as being necessary for the operation of the eddy current brake. The carrier is biased, as by a spring, to the braking position adjacent to one wall of the chamber. A conduit having appropriate valving and connected to the centrifuge source of pressurized air is disposed to conduct the pressured air between the nonmagnetic carrier and that wall of the chamber. When the valve(s) is/are opened to allow the pressurized air into the chamber, the nonmagnetic carrier is pushed against the bias force to the running position. When the valve(s) is/are closed, the bias force pushes the nonmagnetic carrier to the braking position.

DESCRIPTION OF THE PREFERRED EMBODIMENT

Figure 1:
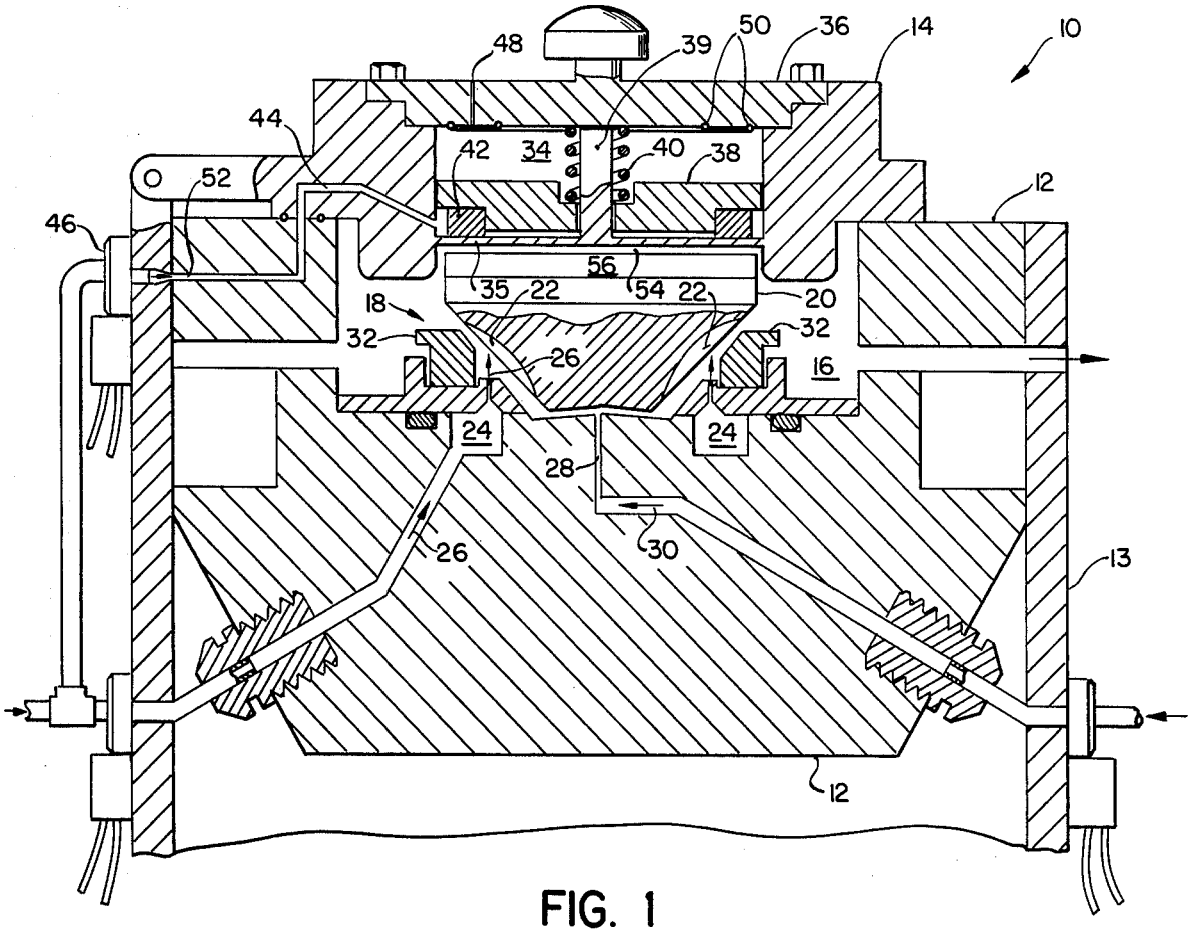
FIG. 1 is a sectional elevation view through an air driven centrifuge employing the preferred embodiment of the present invention.
Figure 2:
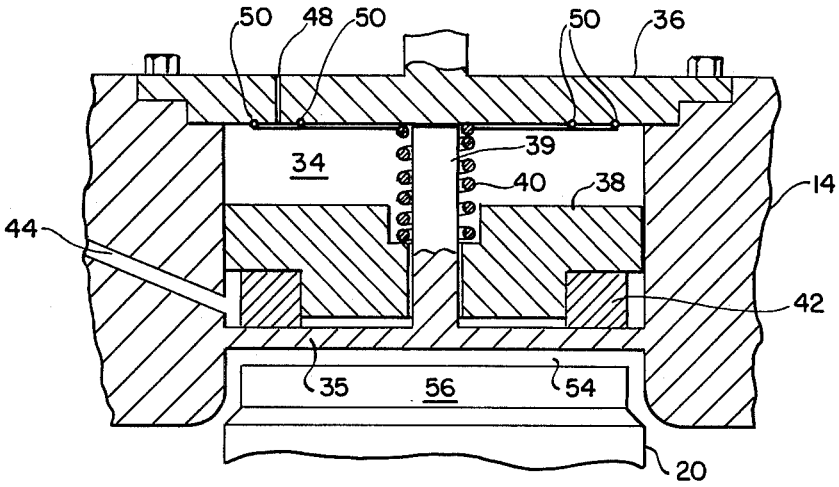
FIG. 2 is an expanded view of the present invention as embodied in the centrifuge of FIG. 1.

Referring to FIG. 1 and FIG. 2, a centrifuge assembly 10 employing a preferred embodiment of the present invention is disclosed. Centrifuge assembly 10 comprises a base 12, supported in an outer housing 13, and a lid 14. With lid 14 in its closed position on base 12 as shown, a rotor chamber 16 is formed having a rotor seat 18 in the bottom thereof. A rotor 20 is designed to fit within rotor chamber 16 as shown. The rotor 20 has a plurality of turbine flutes 22 formed on the under side thereof. The rotor seat 18 includes driving air jet means 24 for impinging pressurized driving air streams 26 against the turbine flutes 22 of the rotor 20 for supporting and spinning the rotor 20 on an air cushion above the rotor seat 18. Support air jet means 28 are also provided in the rotor seat 18. They direct a supporting air stream 30 under pressure against the under side of the rotor 20 for supporting the rotor 20. A support pad 32 is provided in rotor seat 18 for supporting rotor 20 when it is at rest.

The braking apparatus is, in its preferred embodiment as set forth in FIGS. 1 and 2, located in the lid 14. Lid 14 contains a magnet chamber 34 covered by removable cap 36. A nonmagnetic carrier 38 is disposed within the magnet chamber 34. Nonmagnetic carrier 38 is movable vertically within magnet chamber 34, being guided by the inner walls of chamber 34 and guide post 39. Additionally, it is biased adjacent the bottom of magnetic chamber 34 by spring means 40, and has a magnet or a plurality of magnets 42 attached thereto. An energizing air passage 44 communicates with the under side of nonmagnetic carrier 38, as shown, and is attached to a supply of pressurized air through valve means 46. Removable cap 36 contains an air escape passage 48 fitted with O-ring seals 50 as shown.

When valve means 46 is opened, brake release air 52 flows through energizing air passage 44 into magnetic chamber 34 on the under side of nonmagnetic carrier 38. The brake release air 52 lifts nonmagnetic carrier 38 along guide post 39 against the bias of spring means 40. The air in magnet chamber 34 above nonmagnetic carrier 38 escapes through air escape passage 48 as nonmagnetic carrier 38 rises. When the top of nonmagnetic carrier 38 reaches removable cap 36 it seats against O-ring seals 50 and prevents the further escape of air through air escape passage 48. Nonmagnetic carrier 38 then remains in this raised position as long as valve means 46 are open and pressurized air is supplied. When valve means 46 is closed, the flow of brake release air 52 is interrupted. Nonmagnetic carrier 38 is then forced by spring means 40 back against the bottom of magnet chamber 34 in the position shown in FIG. 1. In the descended or braking position shown in FIG. 1, with valve means 46 closed, the magnets 42 are in close proximity to rotor 20, being separated only by the thickness of bottom wall 35 of lid 14 forming the bottom of magnet chamber 34 and by the air gap between bottom wall 35 and rotor 20. The bottom wall 35 of magnet chamber 34 is of a material and thickness such that when magnets 42 are close adjacent bottom wall 35, the required magnetic flux can pass therethrough.

The operating sequence of an air driven centrifuge employing the present invention is as follows. When it is desired to operate the rotor 20 at high speed, the magnet is removed from the vicinity of the rotor 20. This is accomplished, as described above, by opening valve means 46 which allows brake release air stream 52 to force the magnet 42 and nonmagnetic carrier 38 up against the force of spring means 40 until the top of nonmagnetic carrier 38 contacts the seals 50 in cap 36. Normal operation of rotor 20 by the driving air streams 26 can then be accomplished. At termination of the centrifuge run, it is desired to rapidly reduce the speed of the rotor 20, while supporting it on air. One way this can be accomplished is by supporting rotor 20 with air stream 30 and stopping the flow of driving air stream 26. When valve means 46 is closed, spring means 40 forces nonmagnetic carrier 38 and magnet 42 down. Leakage around the side of nonmagnetic carrier 38 allows air in the lower portion of magnet chamber 34 to vent to the upper portion of chamber 34.

The lid 56 of rotor 20 is normally made of aluminum or other electrically conductive material. Thus, with the magnet 42 closely adjacent lid 56, strong eddy currents are generated in the lid due to this rotating member cutting the magnetic flux lines of magnet 42. The eddy currents dissipate the rotor kinetic energy as heat in the rotor lid 56, and cause the rotor 20 to rapidly reduce in rotational speed. The force applied to the rotor by the eddy currents is very uniform so that the rotor remains in its operating axis during deceleration. As an example, it has been found that, by employing the present invention, a rotor weighing 30 grams and rotating at 100,000 r.p.m. can be reduced to a speed of between 100 to 500 r.p.m. in 8 to 12 seconds.

The present invention could be used when positioned other than as shown, and with rotors of various shapes and materials. It is only required that the rotor have an electrically conductive portion such as a lid, insert in the lid, band or ring about the body, or such, sufficient to develop eddy currents capable of stopping the rotor. The magnet means, whether mounted above, to the side, or below, need only be capable of assuming one postion wherein it passes magnetic flux through the electrically conductive portion of the rotating rotor in an amount sufficient to develop the required eddy currents when it is desired to brake the rotor and another position wherein it does not.

Having thus described our invention, we claim:

1. In an air driven centrifuge having a rotor at least a portion of which is formed of an electrically conductive material and means for rotating the rotor on a supporting cushion of pressurized air about an axis, an improved method of braking the rotor when rotating comprising the steps of:

a. moving a source of constant magnetic flux from a first position wherein it is biased against the bias force to a second position by a fluid pressure means to allow the rotor to freely rotate, said first position being so disposed that eddy currents are induced into said electrically conductive portion of the rotating rotor sufficient to produce a braking effect to rapidly reduce the rotation of the rotor, said second position being so disposed that substantially no eddy currents are induced in the electrically conductive portion of the rotating rotor by said magnetic flux; and, b. removing said fluid pressure means whereby said source of constant magnetic flux will be moved by the bias force from said second position to said first position to brake the rotor.

2. In an air driven centrifuge having a rotor at least a portion of which is formed of an electrically conductive material, means for rotating the rotor on a cushion of pressurized air about an axis and means for rotating the rotor about the axis, improved apparatus for braking the rotor when it is rotating comprising:

a. magnet means movable from a first position wherein substantially no eddy currents are induced in the electrically conductive portion of the rotating rotor by the magnetic flux of said magnet means to a second position wherein eddy currents are induced into the electrically conductive portion of the rotating rotor in a quantity sufficient to slow the rotor;

b. means for biasing said magnet means in said second position cooperating with said magnet means; and, c. fluid pressure means for moving said magnet means from said second position to said first position against the force of said bias means.

3. The apparatus of claim 2 wherein said fluid pressure means comprises:

a. a chamber disposed in the means for supporting the rotor, said chamber having a wall adjacent the electrically conductive portion of the rotor, said wall being of a thickness and material that will allow magnetic flux from said magnet means to pass through said wall to induce eddy currents in the electrically conductive portion of the rotating rotor in a quantity sufficient to slow the rotor when said magnet means are disposed adjacent said wall;

b. a nonmagnetic carrier disposed within said chamber, said carrier carrying said magnet means and being movable between said first position wherein said magnet means are positioned away from said wall a distance such that any magnetic flux from said magnet means passing through said wall will induce eddy currents into the electrically conductive portion of the rotating rotor insufficient to slow the rotor and said second position wherein said magnet means are adjacent said wall; and, c. conduit means adapted to be connected to an interruptible source of fluid under pressure at one end and disposed at the other end to conduct the fluid between said nonmagnetic carrier and said wall whereby said nonmagnetic carrier is moved to said first position when fluid under pressure is introduced through said conduit means and said nonmagnetic carrier is returned to said second position from the force of said bias means when no fluid under pressure is introduced through said conduit.

4. In an air driven centrifuge having a rotor at least a portion of which is an electrically conductive material, air pressure means supporting the rotor on an air bearing, and air pressure means for rotating the air supported rotor about an axis, improved apparatus for braking the rotor when it is rotating comprising:

a. a lid having an enclosure therein having a wall thereof disposed adjacent the electrically conductive portion of the rotor when the rotor is rotating, said wall being of a thickness and material whereby magnetic flux can pass from said enclosure through said wall and induce eddy currents in the electrically conductive portion of the rotor sufficient to slow the rotor;

b. a nonmagnetic carrier disposed within said enclosure and adapted for movement therein between a first position not adjacent said wall and a second position adjacent said wall;

c. a magnet carried by said nonmagnetic carrier being of a magnetic strength whereby when said nonmagnetic carrier is in said first position the magnetic flux of said magnet will not pass through said wall in sufficient quantity to induce eddy currents in the electrically conductive portion of the rotor sufficient to brake the rotor and when said nonmagnetic carrier is in said second position the magnetic flux of said magnet will pass through said wall in sufficient quantity to induce eddy currents in the electrically conductive portion of the rotor sufficient to brake the rotor;

d. spring means operably connected to said nonmagnetic carrier whereby said nonmagnetic carrier is biased to said second position; and, e. means for conducting interruptible air pressure between said nonmagnetic carrier and said wall whereby air pressure can be used to force said nonmagnetic carrier to said first position against the bias force of said spring means.

5. Apparatus as claimed in claim 4 and additionally comprising:

guide means disposed within said enclosure and cooperating with said nonmagnetic carrier whereby said nonmagnetic carrier will move between said positions without binding.

* * * * *